US009864338B2

(12) United States Patent
Yamanaka

(10) Patent No.: US 9,864,338 B2
(45) Date of Patent: Jan. 9, 2018

(54) IMAGE FORMING APPARATUS

(71) Applicant: KYOCERA Document Solutions Inc., Osaka (JP)

(72) Inventor: Tatsuya Yamanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/482,202

(22) Filed: Apr. 7, 2017

(65) Prior Publication Data

US 2017/0300009 A1 Oct. 19, 2017

(30) Foreign Application Priority Data

Apr. 13, 2016 (JP) ..... 2016-080036

(51) Int. Cl.
*G03G 21/20* (2006.01)
*G03G 21/16* (2006.01)

(52) U.S. Cl.
CPC ..... *G03G 21/206* (2013.01); *G03G 21/1619* (2013.01)

(58) Field of Classification Search
CPC ..... G03G 21/206; G03G 21/1619; G03G 21/1633; G03G 2221/1609
See application file for complete search history.

(56) References Cited

U.S. PATENT DOCUMENTS 6,101,351 A * 8/2000 Suda ..... G03G 21/1638 399/114
7,184,689 B2 * 2/2007 Kang ..... G03G 21/1832 399/114
8,442,415 B2 * 5/2013 Ushiozu ..... G03G 21/1832 399/110

FOREIGN PATENT DOCUMENTS

JP 2005-91482 A 4/2005
JP 2010-210729 A 9/2010

* cited by examiner

*Primary Examiner* — Gregory H Curran
(74) *Attorney, Agent, or Firm* — Stein IP, LLC

(57) ABSTRACT

An image forming apparatus includes an image carrier, a developing device, a transfer portion, a feeding portion, a main body frame, a fixing device, a discharge portion, a recording-medium conveyance path, an opening/closing member, a cover sheet, a cover moving mechanism, and a cooling portion. The main body frame is arranged above the image carrier. The fixing device is attached to the main body frame. Along with opening/closing of the opening/closing member, the cover moving mechanism causes the cover sheet to reciprocate between a protection position for covering a part of the image carrier on a side of the recording-medium conveyance path and a retraction position between the image carrier and the main body frame. At the retraction position, a passage for an air flow between the cooling portion and the fixing device is blocked by the cover sheet contacting the main body frame.

7 Claims, 7 Drawing Sheets

IMAGE FORMING APPARATUS

INCORPORATION BY REFERENCE

This application is based upon and claims the benefit of priority from the corresponding Japanese Patent Application No. 2016-80034 filed on Apr. 13, 2016, the entire contents of which are incorporated herein by reference.

BACKGROUND

The present disclosure relates to an image forming apparatus employing an electro-photographic method, such as a copier, a printer, a facsimile machine, and a multifunction peripheral (MFP) equipped with functions of these apparatuses, and in particular, the present disclosure relates to an image forming apparatus that cools down a photosensitive member and the like arranged close to a fixing portion.

Conventionally, in an image forming apparatus employing an electro-photographic method, such as a copier, a printer, and a facsimile machine, a toner image is transferred onto a sheet conveyed to a photosensitive drum, the toner image is fixed on the surface of the sheet by a fixing portion, and then the sheet is discharged out of the apparatus. Further, for jam (sheet jam) clearance, an opening/closing body rotatably supported with respect to a main body of the apparatus can be opened to allow a sheet conveyance path from the photosensitive drum to the fixing portion to be opened from the main body of the apparatus.

Here, when the opening/closing body is opened, there is a possibility that a surface of the photosensitive drum may be exposed to an outside of the apparatus to be exposed to external light that may cause deterioration of a photosensitive layer. Further, there is a possibility that the surface of the photosensitive drum exposed to the outside may be contaminated or damaged when it is touched by a human hand or something.

To address these possibilities, a known apparatus is provided with a drum cover which moves, along with movement of the opening/closing body, to a position for covering the photosensitive drum and a position where the drum cover is retracted from the sheet conveyance path. When the opening/closing body is closed, the drum cover is retracted from the sheet conveyance path, so that a toner image on the surface of the photosensitive drum can be transferred onto a sheet. When the opening/closing body is opened for jam clearance, the sheet conveyance path is opened, and at the same time, the drum cover covers a surface of the photosensitive drum that faces the outside of the apparatus main body, to prevent the surface of the photosensitive drum from being exposed to the outside of the apparatus.

There is also known an image forming apparatus that is provided with a cooling portion for reducing exposure of an image forming unit, including a photosensitive drum, a developing device, and the like, to high temperature caused by heat from a fixing device. In this apparatus, when a drum cover for protecting a surface of the photosensitive drum is retracted, the drum cover is located in an air flow generated by the cooling portion.

SUMMARY

According to an aspect of the present disclosure, an image forming apparatus includes an image carrier, a developing device, a transfer portion, a feeding portion, a main body frame, a fixing device, a discharge portion, a recording-medium conveyance path, an opening/closing member, a cover sheet, a cover moving mechanism, and a cooling portion. The image carrier has an electrostatic latent image formed on a surface thereof. The developing device develops the electrostatic latent image formed on the surface of the image carrier into a toner image. The transfer portion transfers the toner image formed on the surface of the image carrier onto a recording medium. The feeding portion feeds the recording medium to the transfer portion. The main body frame is arranged above the image carrier via a predetermined gap. The fixing device is attached to the main body frame, and fixes the toner image onto the recording medium by applying heat and pressure to the recording medium onto which the toner image has been transferred at the transfer portion. The discharge portion discharges the recording medium onto which the toner image has been fixed at the fixing device. The recording-medium conveyance path conveys the recording medium from the feeding portion to the discharge portion. The opening/closing member is capable of opening/closing the recording-medium conveyance path. The cover sheet is flexible and capable of reciprocating between a protection position for covering a part of the image carrier on a side of the recording-medium conveyance path and a retraction position arranged in a gap between the image carrier and the main body frame. The cover moving mechanism causes the cover sheet to reciprocate between the protection position and the retraction position along with opening/closing of the opening/closing member. The cooling portion generates an air flow for cooling down the recording-medium conveyance path from the fixing device to the discharge portion. The cover sheet is arranged at the protection position by the opening of the opening/closing member, and is arranged at the retraction position by the closing of the opening/closing member. A passage for an air flow between the cooling portion and the fixing device is blocked by the cover sheet arranged at the retraction position contacting the main body frame.

Further features and specific advantages of the present disclosure will become apparent from the following descriptions of preferred embodiments.

DETAILED DESCRIPTION

Figure 1:
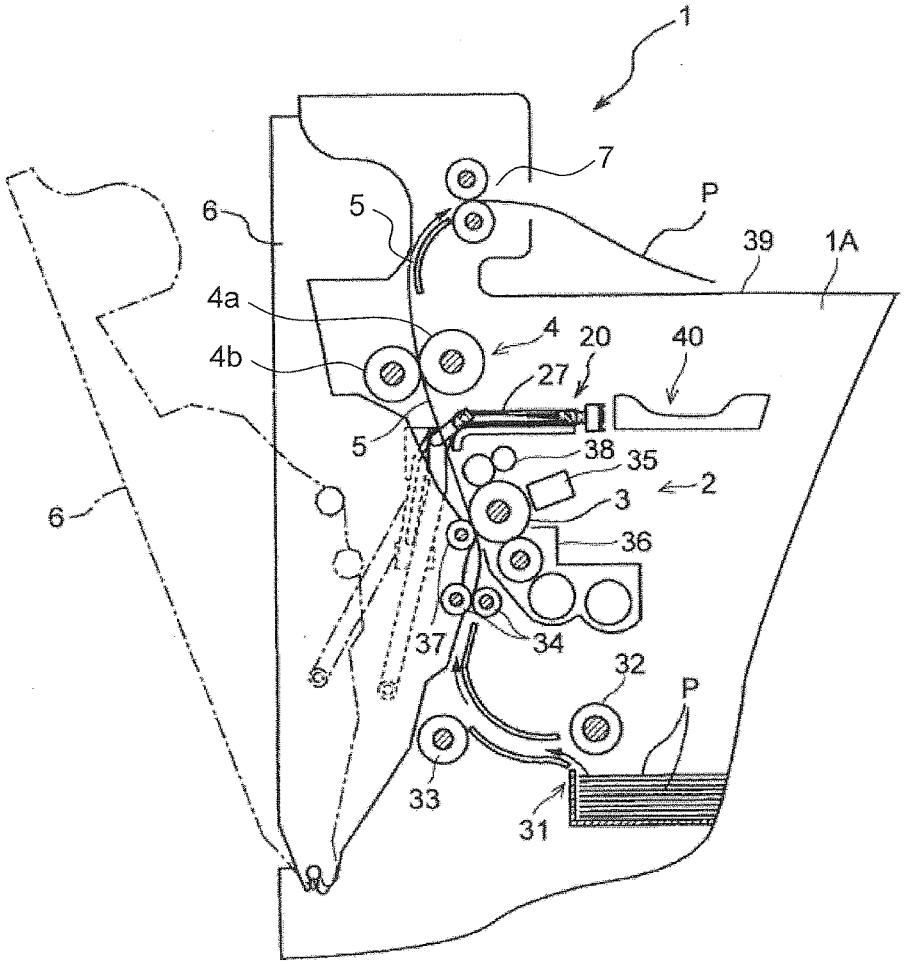
FIG. 1 is a side sectional view illustrating a principal part of an image forming apparatus according to an embodiment of the present disclosure.

Hereinafter, embodiments of the present disclosure will be described with reference to the drawings. FIG. 1 is a side sectional view illustrating a principal part of an image forming apparatus 1 according to an embodiment of the present disclosure. The image forming apparatus 1 is a monochrome printer, and includes a sheet feeding portion 31, which is disposed in a lower part of an apparatus main body 1A, a sheet conveyance path 5, which conveys a sheet P upward from the sheet feeding portion 31, an image forming portion 2, which is disposed to the right of the sheet conveyance path 5, a fixing device 4, which is disposed above the image forming portion 2, a cover moving mechanism 20, which is disposed around a photosensitive drum 3 of the image forming portion 2, and a cooling portion 40, which is disposed to the right of the cover moving mechanism 20.

The sheet feeding portion 31 picks out sheets one by one from a sheet cassette by means of a pickup roller 32, and feeds them to the sheet conveyance path 5. The sheet conveyance path 5 has a conveyance roller 33 and a registration roller pair 34, and conveys a sheet P, fed out of the sheet feeding portion 31, toward the image forming portion 2.

The image forming portion 2 is configured to form a predetermined toner image on a sheet P by an electrophotographic method, and includes the photosensitive drum 3, which is supported about a shaft to be rotatable in a clockwise direction in FIG. 1, and other components, such as a charger 35, a developing device 36, a transfer roller 37, and a cleaning unit 38, which are arranged around the photosensitive drum 3 along a direction in which the photosensitive drum 3 rotates.

The charger 35 is provided with a charging wire which is impressed with a high voltage, and a surface of the photosensitive drum 3 is uniformly charged by corona discharge from the charging wire. In the photosensitive drum 3, a photosensitive layer is formed of a photosensitive material, such as an amorphous silicon photoreceptor or an organic photoreceptor (OPC photoreceptor). When the photosensitive drum 3 is irradiated with laser light from an exposure unit (unillustrated) based on image data transmitted from a host machine such as a personal computer, potential on the surface of the photosensitive drum 3 is selectively attenuated to form an electrostatic latent image on the surface of the photosensitive drum 3.

Next, the developing device 36 develops the electrostatic latent image formed on the surface of the photosensitive drum 3, and thereby a toner image is formed on the surface of the photosensitive drum 3. The toner image formed on the surface of the photosensitive drum 3 is then transferred onto a sheet P via the transfer roller 37. Residual toner remaining on the surface of the photosensitive drum 3 after the transfer is removed by the cleaning unit 38. Residual charge remaining on the surface of the photosensitive drum 3 is removed by a destaticizing unit (unillustrated), so that the photosensitive drum 3 is ready for next image formation.

The sheet P onto which the toner image has been transferred is conveyed toward the fixing device 4 arranged on a downstream side of the sheet conveyance path 5. In the fixing device 4, the sheet P receives heat and pressure while passing through a nip portion (a fixing nip portion) between a fixing roller 4*a* and a pressure roller 4*b*, and thereby the toner image is fixed onto the sheet P. Next, the sheet P having undergone the fixing process is discharged onto a delivery tray 39 by a delivery roller pair 7. The sheet conveyance path 5, extending from the sheet feeding portion 31 to the delivery roller pair 7, is arranged in a left-side part of the apparatus main body 1A to extend substantially in an up-down direction.

At a left side wall of the apparatus main body 1A, there is provided an openable cover 6. The openable cover 6 is configured to be openable and closable with respect to the apparatus main body 1A for jam clearance occurring in the sheet conveyance path 5. When the openable cover 6 is opened, the sheet conveyance path 5 is caused to separate into a part on the apparatus main body 1A side and a part on the openable cover 6 side, so that a sheet stuck in the sheet conveyance path 5 can be removed.

The openable cover 6 is supported about a shaft at a lower end part of the openable cover 6 to be rotatable with respect to the apparatus main body 1A. By operating the openable cover 6 to swing about the shaft, it is possible to switch between an open state, in which an opening is present between the apparatus main body 1A and the openable cover 6 (the state indicated by the dashed-dotted line in FIG. 1), and a closure state, in which the apparatus main body 1A is closed. When the openable cover 6 is in the closure state, image formation can be performed. When the openable cover 6 is in the open state, a cover sheet 27 is caused by the cover moving mechanism 20, which will be described later, to move from a position above the photosensitive drum 3 to a position to the left of the photosensitive drum 3. This makes it possible to prevent damage to the surface of the photosensitive drum 3 from being caused by a touch of an operator's finger or a tool during an operation of jam clearance performed with the openable cover 6 in the open state.

Figure 2:
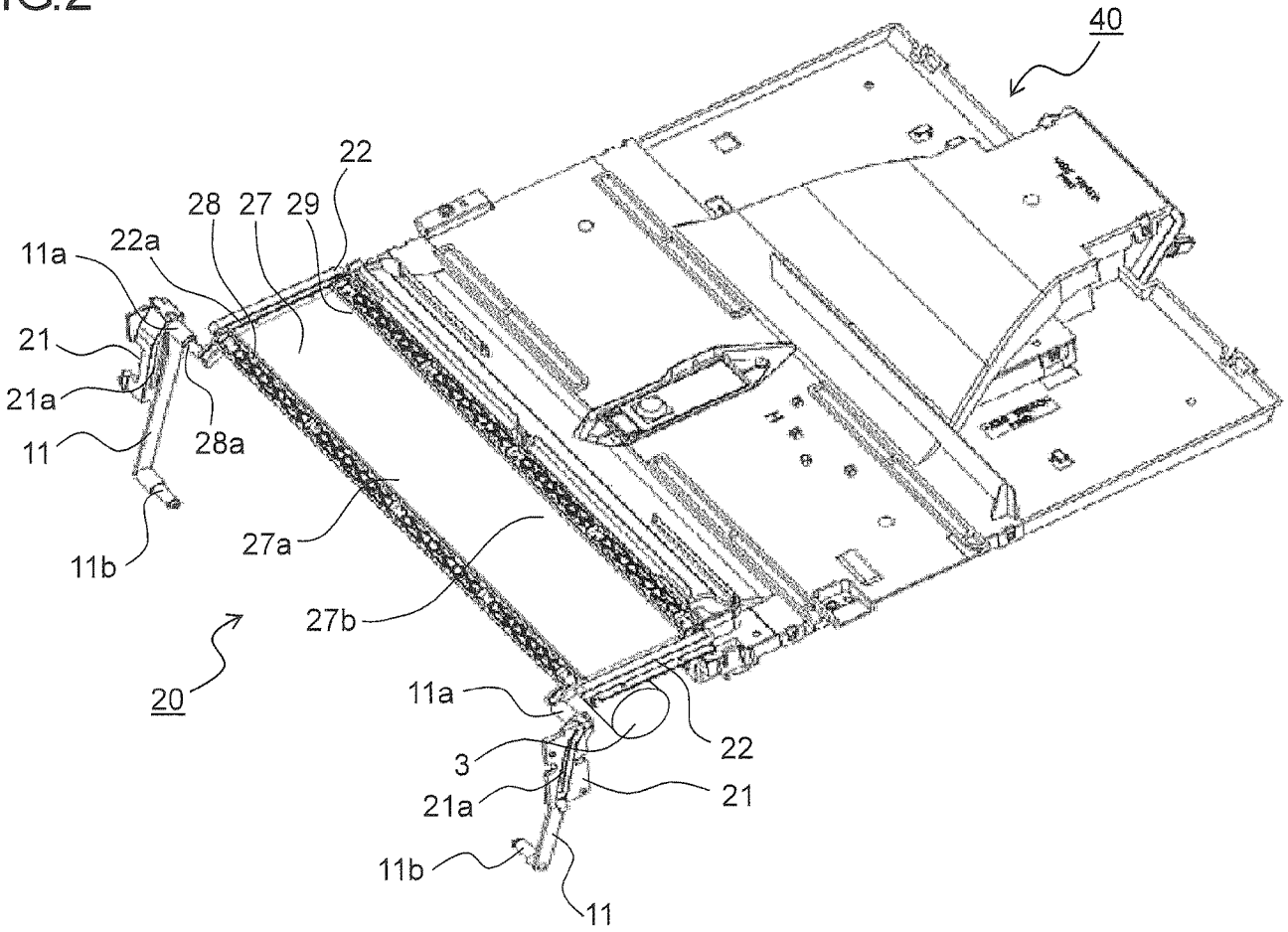
FIG. 2 is a perspective view illustrating a cover moving mechanism in the image forming apparatus of the embodiment, with an openable cover closed.
Figure 3:
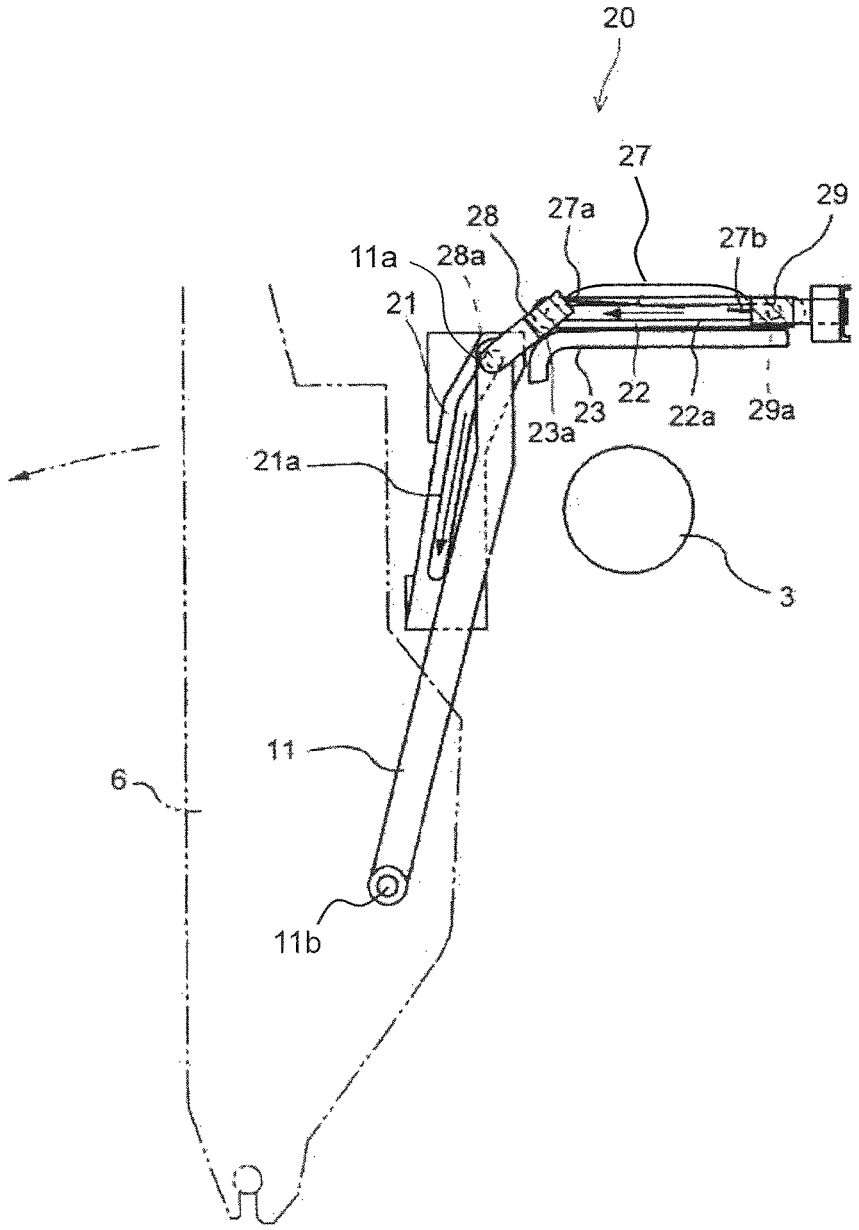
FIG. 3 is a side sectional view illustrating the cover moving mechanism in the image forming apparatus of the embodiment, with the openable cover closed.

FIG. 2 is a perspective view illustrating the cover moving mechanism 20 when the openable cover 6 is in the closure state (at a time of image formation), and FIG. 3 is a side sectional view illustrating a cover moving mechanism 20 when the openable cover 6 is in the closure state. A detailed description will now be given of the cover moving mechanism 20, which causes the cover sheet 27 to move, with reference to FIG. 2 and FIG. 3.

As illustrated in FIG. 2, the cover moving mechanism 20 includes the cover sheet 27, a first sheet holder 28 and a second sheet holder 29, which support the cover sheet 27, arm rails 21, holder rails 22, and a sheet guide 23 (see FIG. 3).

The cover sheet 27 is a flexible sheet member made of an ultra high molecular weight polyethylene, and has its front surface (its surface that does not face the photosensitive drum 3) coated with a heat reflective film and thus is thermally insulative. A length of the cover sheet 27 in its width direction (an axial direction of the photosensitive drum 3) is set to be equal to or greater than a length of the photosensitive drum 3 in its axial direction. A length of the cover sheet 27 in its moving direction (in a left-right direction in FIG. 2 and in an up-down direction in FIG. 3) is set to be approximately double an outer diameter of the photosensitive drum 3. When the openable cover 6 is in the closure state, the cover sheet 27 is located above the photosensitive drum 3.

The first sheet holder 28 fixingly supports a front edge part 27*a* of the cover sheet 27 substantially over an entire width of the cover sheet 27. The second sheet holder 29 fixingly supports a rear edge part 27*b* of the cover sheet 27 substantially over the entire width of the cover sheet 27. The first sheet holder 28 is provided with a pair of first engagement bosses 28*a*, arranged one at each end of the first sheet holder 28 in its length direction. Further, the second sheet holder 29 is provided with a pair of second engagement bosses 29*a*, arranged one at each end of the second sheet holder 29 in its length direction.

The arm rails 21 and the holder rails 22 are fixedly provided on the apparatus main body 1A in such a manner the arm rails 21 are arranged in a pair opposite to each other in a width direction of the apparatus main body 1A, and so are the holder rails 22. The arm rails 21 have length rail grooves 21*a* formed one in each of the arm rails 21 to extend substantially in the up-down direction, and the holder rails 22 have lateral rail grooves 22*a* formed one in each of the holder rails 22 to extend substantially in a horizontal direction.

The first engagement bosses 28*a*, formed at both ends of the first sheet holder 28, are swingably coupled to swing shafts 11*a*, formed at upper ends of a pair of link arms 11. The swing shafts 11*a* engage with the length rail grooves 21*a* formed in the arm rails 21. The link arms 11 are swingably supported to the openable cover 6 by swing supports 11*b* formed one at lower ends of the link arms 11. The first sheet holder 28 is movable along with the openable cover 6 via the link arms 11.

The second engagement bosses 29*a*, formed at both ends of the second sheet holder 29, are swingably engaged with the lateral rail grooves 22*a* formed in the holder rails 22.

The sheet guide 23 is disposed between the pair of holder rails 22. The sheet guide 23 horizontally extends along the lateral rail grooves 22*a* so as to face a lower surface of the cover sheet 27, and further has an arc-shaped curved portion 23*a* formed at a left end (on a side of the arm rails 21) of the sheet guide 23. When the first sheet holder 28 moves in the up-down direction and the second sheet holder 29 moves in the horizontal direction, the cover sheet 27 supported by the first sheet holder 28 and the second sheet holder 29 is guided to the curved portion 23*a* of the sheet guide 23, and moves in an arc surrounding the photosensitive drum 3.

Figure 4:
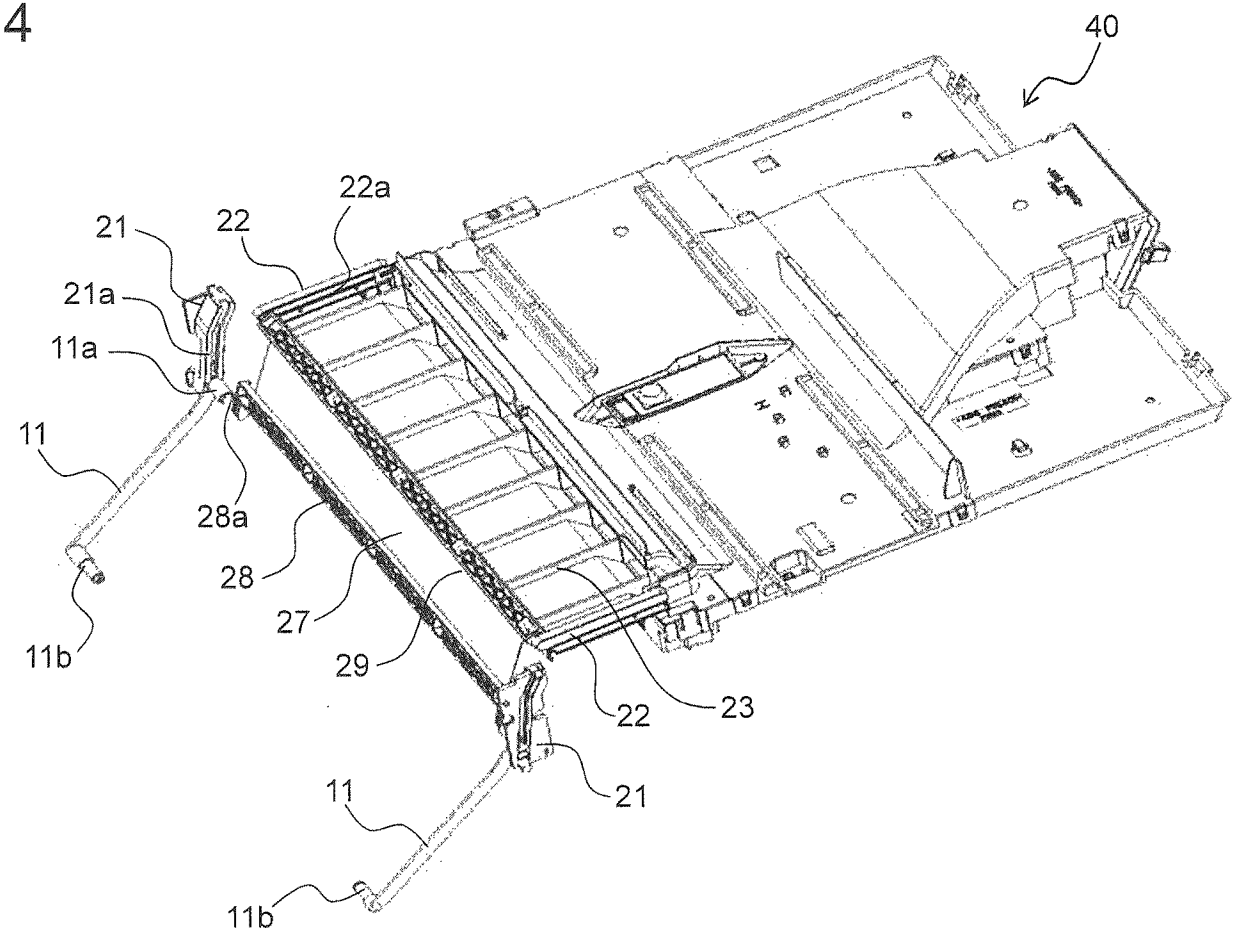
FIG. 4 is a perspective view illustrating the cover moving mechanism in the image forming apparatus of the embodiment, with the openable cover opened.
Figure 5:
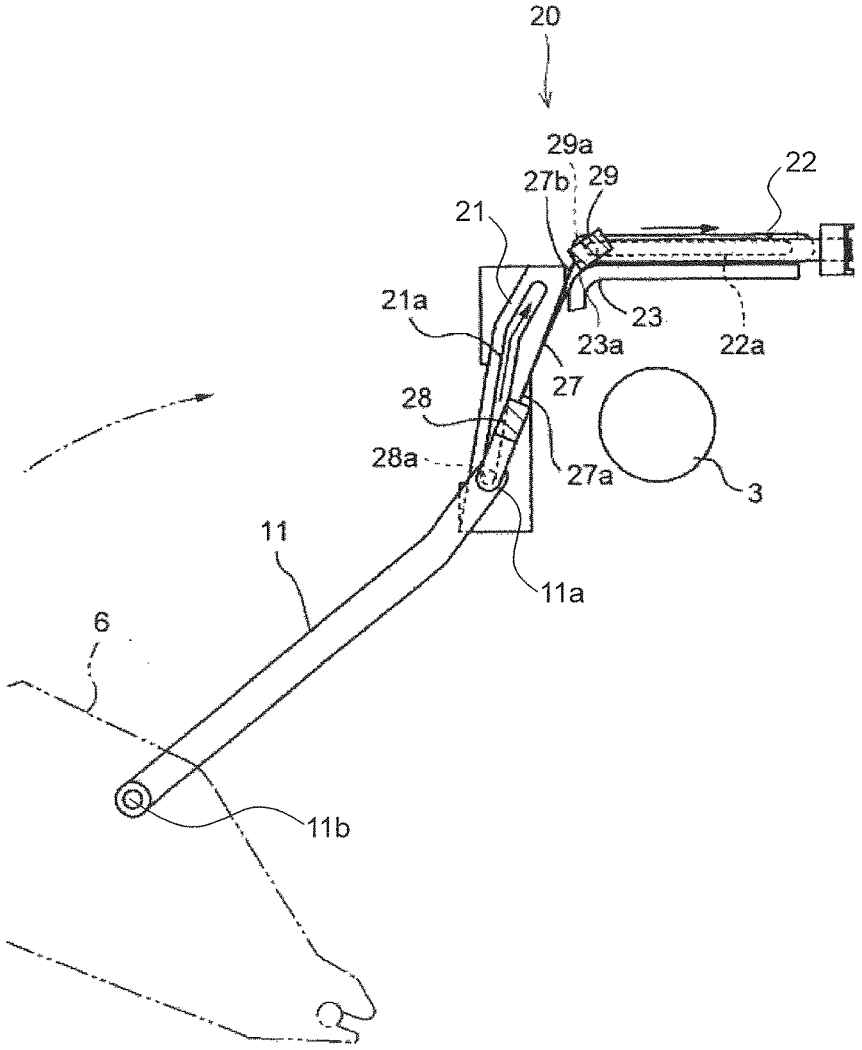
FIG. 5 is a side sectional view illustrating the cover moving mechanism in the image forming apparatus of the embodiment, with the openable cover opened.

FIG. 4 is a perspective view illustrating the cover moving mechanism 20, with the openable cover 6 in the open state, and FIG. 5 is a side sectional view illustrating the cover moving mechanism 20, with the openable cover 6 in the open state. With reference to FIGS. 2 and 3, and FIGS. 4 and 5, a description will be given of an operation of moving the cover sheet 27 performed by the cover moving mechanism 20.

When the openable cover 6 is in the closure state, as illustrated in FIGS. 2 and 3, the cover sheet 27 is arranged at a position above the photosensitive drum 3 but below the fixing device 4 (see FIG. 1) (hereinafter referred to as a retraction position). Here, the length of the cover sheet 27 in its moving direction (the left-right direction in FIG. 3) is longer than a length from upper ends of the length rail grooves 21*a* (the position of the first sheet holder 28 in the retraction position) to right ends of the lateral rail grooves 22*a* (the position of the second sheet holder 29 in the retraction position), and thus, in the retraction position, the cover sheet 27 is warped. More specifically, since the sheet guide 23 exists under the cover sheet 27, the cover sheet 27 is warped upward as illustrated in FIG. 3.

When the openable cover 6 is rotated in an opening direction, as indicated by a two-dot-dashed-line arrow in FIG. 3, from the closure state, the link arms 11 move along with the openable cover 6, and the swing shafts 11 a move from the upper ends of the length rail grooves 21*a* in a direction indicated by a solid-line arrow in FIG. 3. Along with these movements, the first sheet holder 28, which is coupled to the swing shafts 11*a* of the link arms 11, also moves downward along the length rail grooves 21*a*.

Further, along with the movement of the first sheet holder 28, the second sheet holder 29 also moves, via the cover sheet 27, leftward from the right ends of the lateral rail grooves 22*a* in a direction indicated by a solid-line arrow in FIG. 3. Thereby, the cover sheet 27 is guided along the sheet guide 23 while being stretched from its warped state, and moves at the curved portion 23*a* in an arc surrounding the photosensitive drum 3. As a result, as illustrated in FIG. 4 and FIG. 5, the cover sheet 27 is brought into a position (hereinafter, a protection position) where the cover sheet 27 covers a part of the photosensitive drum 3 on a side of the sheet conveyance path 5.

When the openable cover 6 is rotated in a closing direction, as indicated by a two-dot-dashed-line arrow in FIG. 5, from the open state, the link arms 11 move along with the openable cover 6, and the swing shafts 11*a* move from the lower ends of the length rail grooves 21*a* in a direction indicated by a solid-line arrow in FIG. 5. Along with these movements, the first sheet holder 28, which is coupled to the swing shafts 11*a* of the link arms 11, also moves upward along the length rail grooves 21*a*. Further, along with the upward movement of the first sheet holder 28, force to compress the cover sheet 27 is applied to the cover sheet 27 between the first sheet holder 28 and the second sheet holder 29. As a result, the second sheet holder 29 is pressed by the cover sheet 27 with its restoration force (elastic force), to move along the lateral rail grooves 22*a* in a direction (rightward) as indicated by a solid-line arrow in FIG. 5. The cover sheet 27 is guided along the sheet guide 23 in the stretched state until the second sheet holder 29 reach the right ends of the lateral rail grooves 22, and at the curved portion 23*a*, the sheet cover 27 moves in an arc surrounding the photosensitive drum 3.

Here, the link arms 11 continue to rotate after the second sheet holder 29 reaches the right ends of the lateral rail grooves 22*a* and stops, so that the swing shafts 11*a* move toward the upper ends of the length rail grooves 21*a*. As a result, distance between the first sheet holder 28 and the second sheet holder 29 becomes shorter than the length of the cover sheet 27 in its moving direction, and thus the cover sheet 27 becomes warped from its stretched state while moving to above the photosensitive drum 3, and returns to the retraction position indicated in FIG. 2 and FIG. 3.

Figure 6:
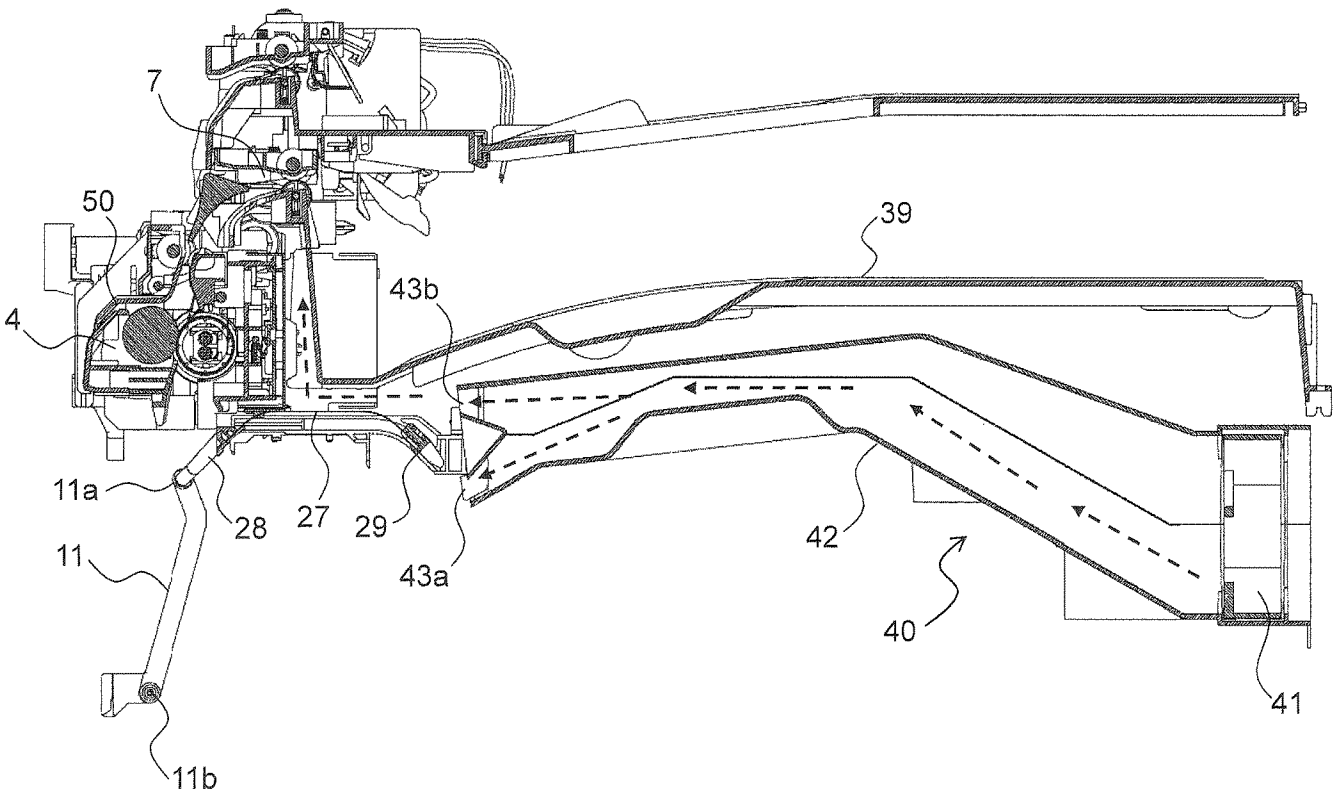
FIG. 6 is a side sectional view illustrating a configuration of an area around a cooling portion of the image forming apparatus of the embodiment.
Figure 7:
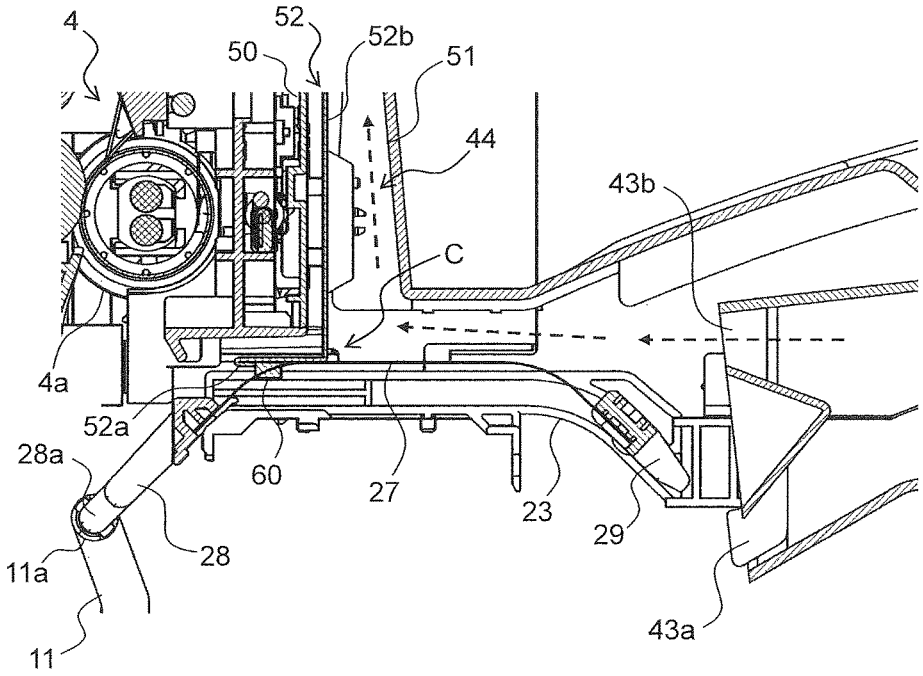
FIG. 7 is an enlarged view of an area around an outlet port of a first duct illustrated in FIG. 6.

FIG. 6 is a side sectional view illustrating a configuration of an area around the cooling portion 40 of the image forming apparatus 1, and FIG. 7 is an enlarged view of a part around outlet ports 43*a* and 43*b* of a first duct 42 illustrated in FIG. 6. With reference to FIGS. 1 and 2 and FIGS. 6 and 7, a description will be given of an arrangement and a configuration of the cooling portion 40.

As illustrated in FIG. 1 and FIG. 2, the cooling portion 40 is disposed behind the sheet conveyance path 5 as viewed from the openable cover 6 side. The cooling portion 40 cools down an image forming unit including the photosensitive drum 3, the developing device 36, the cleaning unit 38, and the like, to which heat coming from the fixing device 4 is transferred, and a sheet P which is conveyed passing through the fixing device 4 and along the sheet conveyance path 5.

As illustrated in FIG. 6 and FIG. 7, the cooling portion 40 includes a blower fan 41, the first duct 42, and a second duct 44. The blower fan 41 is an intake fan which takes in air from outside the apparatus main body 1A. Air taken in via the blower fan 41 flows through the first duct 42 to reach the first outlet port 43*a* and the second outlet port 43*b*.

The air discharged through the first outlet port 43*a* flows below the cover sheet 27 to reach the photosensitive drum 3, the developing device 36, the cleaning unit 38, and the like, and cools them down. Thereby, it is possible to reduce fluidity deterioration of toner in the developing device 36 and of exhaust toner in the cleaning unit 38 caused by the heat from the fixing device 4.

The air discharged from the second outlet port 43*b* flows above the cover sheet 27, then flows upward through the second duct 44, which is formed between a side face 52*b* of a main body frame 52 and an inner wall face 51 of the apparatus main body 1A, a housing 50 of the fixing device 4 being attached to the side face 52*b*, and then the air is sent to the sheet conveyance path 5, which connects the fixing device 4 to the delivery roller pair 7. Thereby, it is possible to cool down a sheet passing through the fixing device 4 toward the delivery roller pair 7, and to cool down toner fused with heat from the fixing roller 4*a* to thereby reduce adhesion of toner to the sheet conveyance path 5, the delivery roller pair 7, and the like. Further, when a sheet which has absorbed moisture passes through the fixing device 4, water vapor is sometimes emitted from the heated sheet to rise up and become condensed water vapor. However, the water vapor is dispersed by the air sent through the second duct 44 to the sheet conveyance path 5, and this eliminates the risk of the user mistaking the condensed water vapor as smoke.

In the present embodiment, as illustrated in FIG. 7, when the cover sheet 27 is arranged at the retraction position, the cover sheet 27 is warped upward into contact with a lower end portion 52*a* of the main body frame 52, the lower end portion 52*a* being located below the fixing device 4. As a result, a contact portion C, at which the cover sheet 27 and the main body frame 52 contact each other, closes a gap between the cover sheet 27 and the lower end portion 52*a* of the main body frame 52. Thereby, air discharged through the second outlet port 43*b* is not sent toward the fixing roller 4*a*, but passes upward through the second duct 44, which is formed between the side face 52*b* of the main body frame 52 and the inner wall face 51 of the apparatus main body 1A, to be efficiently guided to the sheet conveyance path 5.

Thus, it is possible to effectively cool down a sheet passing through the fixing device 4 to be conveyed to the delivery roller pair 7, and thus to reduce pollution of the sheet conveyance path 5 and the delivery roller pair 7 caused by adhesion of fused toner. Further, since the air discharged through the second outlet port 43*b* is not sent toward the fixing roller 4*a*, it is possible to reduce power loss caused when the fixing roller 4*a* is cooled down.

Further, as illustrated in FIG. 7, a cleaning member 60 is fixed to the lower end portion 52*a* of the main body frame 52, the lower end portion 52*a* facing the cover sheet 27. The cleaning member 60 faces the cover sheet 27 over an entire area of the cover sheet 27 in its width direction (a direction perpendicular to the surface of the sheet on which FIG. 7 is drawn). Along with the operation of moving the cover sheet 27 performed by the cover moving mechanism 20, the front surface (the surface that does not face the photosensitive drum 3) of the cover sheet 27 is rubbed by the cleaning member 60. Thereby, it is possible to automatically remove dirt such as paper powder and toner adhered to the front surface of the cover sheet 27, and thus to maintain decent appearance of the cover sheet 27 as viewed by an operator when the openable cover 6 is opened. The cleaning member 60 is made of a material such as sponge, unwoven cloth, or the like.

In the present embodiment, the cleaning member 60 is arranged on the lower end portion 52*a* of the main body frame 52, the lower end portion 52*a* facing the front surface of the cover sheet 27, but the cleaning member 60 may be arranged along the sheet guide 23, which faces a back surface (the surface that faces the photosensitive drum 3) of the cover sheet 27 to remove dirt from the back surface of the cover sheet 27. Here, however, since dust and dirt such as paper powder, toner, and the like tend to accumulate on the front surface of the cover sheet 27, the configuration of the present embodiment is preferable in which the cleaning member 60 is arranged on the side of the front surface of the cover sheet 27. The cleaning member 60 may be arranged to contact each of the front surface and the back surface of the cover sheet 27.

It should be understood that the present disclosure is not limited to the above embodiments, and various modifications are possible within the scope of the present disclosure. For example, the above embodiment has dealt with an example where the blower fan 41 is an intake fan, but this is not meant to limit the present disclosure. The blower fan 41 may be an exhaust fan such that heat around the photosensitive drum 3, the developing device 36, and the cleaning unit 38, and around the sheet conveyance path 5 is discharged to outside the apparatus main body 1A by the blower fan 41 via the first duct 42.

Further, the above embodiment has dealt with an example where the outlet port of the first duct 42 branches into the first outlet port 43*a* and the second outlet port 43*b*, but this is not meant to limit the present disclosure, and the outlet port may branch into three or more outlet ports.

Further, application of the present disclosure is not limited to a monochrome printer as illustrated in FIG. 1, but the present disclosure is applicable to various image forming apparatuses, such as a color printer, monochrome and color copiers, and a facsimile machine, provided with a drum cover for protecting a photosensitive drum.

The present disclosure can be used in an image forming apparatus employing the electro-photographic method, such as a copier, a printer, a facsimile machine, or a multifunction peripheral having functions of these. By using the present disclosure, it is possible to provide an image forming apparatus which uses a cover for protecting an image carrier to restrict the flow of cooling air to thereby make it possible to efficiently cool down a recording medium having passed through a fixing device and to reduce power loss in the fixing device.

What is claimed is:

1. An image forming apparatus comprising:

an image carrier on a surface of which an electrostatic latent image is formed;

a developing device which develops the electrostatic latent image formed on the surface of the image carrier into a toner image;

a transfer portion which transfers the toner image formed on the surface of the image carrier onto a recording medium;

a feeding portion which feeds the recording medium to the transfer portion;

a main body frame which is arranged above the image carrier via a predetermined gap;

a fixing device which is attached to the main body frame, and fixes the toner image onto the recording medium by applying heat and pressure to the recording medium onto which the toner image has been transferred at the transfer portion;

a discharge portion which discharges the recording medium onto which the toner image has been fixed at the fixing device;

a recording-medium conveyance path which conveys the recording medium from the feeding portion to the discharge portion;

an opening/closing member which is capable of opening and closing the recording-medium conveyance path;

a cover sheet which is flexible and capable of reciprocating between a protection position for covering a part of the image carrier on a side of the recording-medium conveyance path and a retraction position arranged in the predetermined gap between the image carrier and the main body frame;

a cover moving mechanism which causes the cover sheet to reciprocate between the protection position and the retraction position along with opening and closing of the opening/closing member; and a cooling portion which generates an air flow for cooling down the recording-medium conveyance path from the fixing device to the discharge portion, wherein the cover sheet is arranged at the protection position by the opening of the opening/closing member, and is arranged at the retraction position by the closing of the opening/closing member, and a passage for an air flow between the cooling portion and the fixing device is blocked by the cover sheet arranged at the retraction position contacting the main body frame.

2. The image forming apparatus according to claim 1, wherein the cover moving mechanism comprises a first sheet holder which holds one edge of the cover sheet in a moving direction of the cover sheet, a second sheet holder which holds another edge of the cover sheet in the moving direction of the cover sheet, a pair of link arms including swing shafts to which both ends of the first sheet holder are rotatably coupled, and swing supports rotatably supported to the opening/closing member, a pair of arm rails which slidably support the swing shafts of the pair of link arms, and a pair of holder rails which slidably support both ends of the second sheet holder; and when the cover sheet is moved to the retraction position, a distance between the first sheet holder and the second sheet holder becomes shorter than a length of the cover sheet in the moving direction of the cover sheet to cause the cover sheet to warp and come into contact with the main body frame.

3. The image forming apparatus according to claim 1, wherein the cooling portion comprises a blower fan which generates an air flow, a first duct which guides the air flow generated by the blower fan to the fixing device, and a second duct which guides the air flow guided by the first duct, from where the cover sheet contacts the main body frame to the recording-medium conveyance path between the fixing device and the discharge portion.

4. The image forming apparatus according to claim 1, further comprising a cleaning member which comes into contact with at least one of a front surface and a back surface of the cover sheet when the cover sheet reciprocates between the protection position and the retraction position.

5. The image forming apparatus according to claim 4, wherein the cleaning member comes into contact with the front surface of the cover sheet when the cover sheet reciprocates between the protection position and the retraction position.

6. The image forming apparatus according to claim 4, wherein the cleaning member is arranged on a surface of the main body frame that faces the cover sheet.

7. The image forming apparatus according to claim 4, further comprising a guide member which supports a surface of the cover sheet that faces the image carrier, wherein the cleaning member is arranged on the guide member.

* * * * *